US010737319B2

(12) United States Patent
Noda et al.

(10) Patent No.: US 10,737,319 B2
(45) Date of Patent: Aug. 11, 2020

(54) CONTROL METHOD FOR AUTOMATIC POURING APPARATUS, AUTOMATIC POURING APPARATUS, CONTROL PROGRAM, AND COMPUTER-READABLE RECORDING MEDIUM STORING CONTROL PROGRAM

(71) Applicants: SINTOKOGIO, LTD., Nagoya-shi, Aichi (JP); UNIVERSITY OF YAMANASHI, Kofu-shi, Yamanashi (JP)

(72) Inventors: Yoshiyuki Noda, Kofu (JP); Yuta Sueki, Kofu (JP); Makio Suzuki, Toyokawa (JP); Kazuhiro Ota, Toyokawa (JP)

(73) Assignees: SINTOKOGIO, LTD., Nagoya-shi, Aichi (JP); UNIVERSITY OF YAMNASHI, Kofu-shi, Yamanashi (JP)

( * ) Notice: Subject to any disclaimer, the term of this patent is extended or adjusted under 35 U.S.C. 154(b) by 414 days.

(21) Appl. No.: 15/693,978

(22) Filed: Sep. 1, 2017

(65) Prior Publication Data

US 2018/0236535 A1 Aug. 23, 2018

(30) Foreign Application Priority Data

Feb. 20, 2017 (JP) ..... 2017-029119

(51) Int. Cl.
*B22D 37/00* (2006.01)
*B22D 41/04* (2006.01)

(52) U.S. Cl.
CPC ..... *B22D 37/00* (2013.01); *B22D 41/04* (2013.01)

(58) Field of Classification Search
CPC ..... B22D 37/00; B22D 41/04
(Continued)

(56) References Cited

U.S. PATENT DOCUMENTS 6,280,499 B1 * 8/2001 Koffron ..... C21C 5/4673 266/236
8,062,578 B2 * 11/2011 Noda ..... B22D 37/00 222/590

(Continued)

FOREIGN PATENT DOCUMENTS

JP H11-207458 A 8/1999
JP H11-342463 A 12/1999

(Continued)

OTHER PUBLICATIONS

Y. Sueki et al., "Optimal Positioning of Ladle for Minimizing Molten Metal Spilling from Sprue in Tilting-ladle Type Automatic Pouring Machine", Japan Foundry Engineering Society, Sep. 5, 2016, p. 133.

(Continued)

*Primary Examiner* — Scott R Kastler
*Assistant Examiner* — Michael Aboagye
(74) *Attorney, Agent, or Firm* — Faegre Drinker Biddle & Reath LLP

(57) ABSTRACT

A leakage of a molten metal is suppressed at the time of pouring.

A control method for an automatic pouring apparatus according to one embodiment includes: calculating a dropping position of a molten metal on a horizontal surface passing through a height position of a sprue, a flow velocity of the molten metal in the dropping position, and a radius of a sectional surface of the molten metal on the horizontal surface, on the basis of a dropping trajectory of the molten metal flowing out from a discharge port, generating an objective function which is relevant to a total weight of the molten metal flowing into a mold from a ladle and depends on a distance between the discharge port and the center of the sprue in a predetermined direction, on the basis of the dropping position, the flow velocity of the molten metal in (Continued)

the dropping position, the radius of the sectional surface of the molten metal on the horizontal surface, a radius of the sprue, a flow rate of the molten metal flowing out from the discharge port, and a density of the molten metal, and calculating the distance between the discharge port and the center of the sprue in the predetermined direction, in which the total weight of the molten metal flowing into the mold from the ladle is maximized, on the basis of the objective function.

5 Claims, 16 Drawing Sheets

(58) Field of Classification Search
USPC ..... 222/590, 591, 604; 266/98, 99, 236; 164/136, 335, 336
See application file for complete search history.

(56) References Cited

U.S. PATENT DOCUMENTS 8,114,338 B2 * 2/2012 Noda ..... B22D 41/06 266/44
8,875,960 B2 * 11/2014 Terashima ..... B22D 37/00 222/604
9,248,498 B2 * 2/2016 Noda ..... B22D 35/04
9,950,364 B2 * 4/2018 Suzuki ..... B22D 41/04

FOREIGN PATENT DOCUMENTS

JP 2008-272802 A 11/2008
JP 2011-224631 A 11/2011
JP 2012-016708 A 1/2012
JP 2013-188760 A 9/2013
JP 2013-244504 A 12/2013

OTHER PUBLICATIONS

Y. Sueki et al., "Optimal Positioning of Ladle for Minimizing Molten Metal Spilling from Sprue in Tilting-ladle Type Automatic Pouring Machine", the 168th General Meeting of Japan Foundry Engineering Society, Sep. 25, 2016, p. 1-p. 18.

* cited by examiner

CONTROL METHOD FOR AUTOMATIC POURING APPARATUS, AUTOMATIC POURING APPARATUS, CONTROL PROGRAM, AND COMPUTER-READABLE RECORDING MEDIUM STORING CONTROL PROGRAM

TECHNICAL FIELD

Embodiments of the present invention relate to a control method for an automatic pouring apparatus, an automatic pouring apparatus, a control program, and a computer-readable recording medium storing a control program.

BACKGROUND

A tilting automatic pouring apparatus has been used as one type of automatic pouring apparatus. For example, tilting automatic pouring apparatuses described in Japanese Unexamined Patent Publication No. H11-207458, Japanese Unexamined Patent Publication No. H11-342463, Japanese Unexamined Patent Publication No. 2012-16708, and Japanese Unexamined Patent Publication No. 2013-244504 are known as the tilting automatic pouring apparatus. Such a tilting automatic pouring apparatus tilts a ladle accumulating a molten metal, and thus, allows the molten metal flowing out from a discharge port of the ladle to flow into a mold through a sprue of the mold.

In such a tilting automatic pouring apparatus, it is necessary to allow the molten metal flowing out from the discharge port of the ladle to accurately flow into the sprue of the mold. For example, technologies described in Japanese Unexamined Patent Publication No. 2008-272802, Japanese Unexamined Patent Publication No. 2011-224631, and Japanese Unexamined Patent Publication No. 2013-188760 are known as a technology for allowing the molten metal to accurately flow into the sprue of the mold.

In Japanese Unexamined Patent Publication No. 2008-272802, it is described that a dropping position of the molten metal in a height position of the sprue of the mold is calculated from a dropping trajectory of the molten metal flowing out from the discharge port of the ladle, and the position of the ladle is dynamically controlled such that the dropping position is coincident with the position of the sprue of the mold, and thus, the molten metal accurately flows into the mold. In Japanese Unexamined Patent Publication No. 2011-224631, it is described that the position of the ladle is dynamically controlled by the same method as the method described in Japanese Unexamined Patent Publication No. 2008-272802, and then, a dropping position of an actual molten metal is measured by an optical sensor, and according to the result, the position of the ladle is corrected. In Japanese Unexamined Patent Publication No. 2013-188760, it is described that the dropping position of the molten metal is calculated by the same method as the method described in Japanese Unexamined Patent Publication No. 2008-272802, and the ladle is transported such that the dropping position is a target position and a height position of the discharge port based on the sprue of the mold is a low position.

SUMMARY

In the methods described in Japanese Unexamined Patent Publication No. 2008-272802, Japanese Unexamined Patent Publication No. 2011-224631, and Japanese Unexamined Patent Publication No. 2013-188760, the dropping trajectory of the molten metal is calculated by using a flow velocity of the molten metal flowing out from the discharge port of the ladle. Therefore, in a case where the flow velocity of the molten metal is changed over time, the dropping position of the molten metal, which is calculated on the basis of the dropping trajectory of the molten metal, is also changed over time. In this case, the ladle is moved according to a variation in the flow velocity of the molten metal such that the dropping position of the molten metal is coincident with the position of the sprue of the mold, and as a result thereof, a vibration occurs on a fluid level of the molten metal in the ladle while the molten metal is poured. Such a vibration is a factor of allowing the flow velocity of the molten metal in the discharge port of the ladle to further vary, and a variation in the dropping position of the molten metal to occur. In a case where a variation occurs in the dropping position of the molten metal, there is a concern that the molten metal from the ladle drops in a position deviating from the sprue of the mold, that is a so-called leakage of the molten metal occurs.

Accordingly, in this technical field, a method of suppressing the leakage of the molten metal at the time of pouring is required.

In an aspect, a control method for an automatic pouring apparatus pouring a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, and a second driving unit for tilting the ladle. The method according to the aspect includes: calculating a dropping position of the molten metal on a horizontal surface passing through a height position of the sprue, a flow velocity of the molten metal in the dropping position, and a radius of a sectional surface of the molten metal on the horizontal surface, on the basis of a dropping trajectory of the molten metal flowing out from the discharge port, generating an objective function which is relevant to a total weight of the molten metal flowing into the mold from the ladle and depends on a distance between the discharge port and the center of the sprue in the predetermined direction, on the basis of the dropping position, the flow velocity of the molten metal in the dropping position, the radius of the sectional surface of the molten metal on the horizontal surface, a radius of the sprue, a flow rate of the molten metal flowing out from the discharge port, and a density of the molten metal, and calculating the distance between the discharge port and the center of the sprue in the predetermined direction, in which the total weight of the molten metal flowing into the mold from the ladle is maximized, on the basis of the objective function.

In an aspect, an automatic pouring apparatus pouring a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit controlling the first driving unit and the second driving unit. The control unit calculates a dropping position of the molten metal on a horizontal surface passing through a height position of the sprue, a flow velocity of the molten metal in the dropping position, and a radius of a sectional surface of the molten metal on the horizontal surface, on the basis of a dropping trajectory of the molten metal flowing out from the discharge port, generates an objective function which is relevant to a total weight of the molten metal flowing into the mold from the ladle and depends on a distance between the discharge port and the center of the sprue in the predetermined direction, on the basis of the dropping position, the flow velocity of the molten metal in the dropping position, the radius of the sectional surface of the molten metal on the horizontal surface, a radius of the sprue, a flow rate of the molten metal flowing out from the discharge port, and a density of the molten metal, and calculates the distance between the discharge port and the center of the sprue in the predetermined direction, in which the total weight of the molten metal flowing into the mold from the ladle is maximized, on the basis of the objective function.

In an aspect, a control program for allowing an automatic pouring apparatus to function to pour a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit controlling the first driving unit and the second driving unit. The control program allows the control unit to execute: calculating a dropping position of the molten metal on a horizontal surface passing through a height position of the sprue, a flow velocity of the molten metal in the dropping position, and a radius of a sectional surface of the molten metal on the horizontal surface, on the basis of a dropping trajectory of the molten metal flowing out from the discharge port, generating an objective function which is relevant to a total weight of the molten metal flowing into the mold from the ladle and depends on a distance between the discharge port and the center of the sprue in the predetermined direction, on the basis of the dropping position, the flow velocity of the molten metal in the dropping position, the radius of the sectional surface of the molten metal on the horizontal surface, a radius of the sprue, a flow rate of the molten metal flowing out from the discharge port, and a density of the molten metal, and calculating the distance between the discharge port and the center of the sprue in the predetermined direction, in which the total weight of the molten metal flowing into the mold from the ladle is maximized, on the basis of the objective function.

In an aspect, a computer-readable recording medium storing a control program for allowing an automatic pouring apparatus to function to pour a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit controlling the first driving unit and the second driving unit. The control program allows the control unit to execute: calculating a dropping position of the molten metal on a horizontal surface passing through a height position of the sprue, a flow velocity of the molten metal in the dropping position, and a radius of a sectional surface of the molten metal on the horizontal surface, on the basis of a dropping trajectory of the molten metal flowing out from the discharge port, generating an objective function which is relevant to a total weight of the molten metal flowing into the mold from the ladle and depends on a distance between the discharge port and the center of the sprue in the predetermined direction, on the basis of the dropping position, the flow velocity of the molten metal in the dropping position, the radius of the sectional surface of the molten metal on the horizontal surface, a radius of the sprue, a flow rate of the molten metal flowing out from the discharge port, and a density of the molten metal, and calculating the distance between the discharge port and the center of the sprue in the predetermined direction, in which the total weight of the molten metal flowing into the mold from the ladle is maximized, on the basis of the objective function.

In the control method for an automatic pouring apparatus, the automatic pouring apparatus, the control program, and the computer-readable recording medium storing a control program according to the aspect, the distance between the discharge port and the center of the sprue in the predetermined direction, in which the total weight of the molten metal flowing into the mold from the ladle is maximized, is calculated. The position corresponding to the distance is a position the total weight of the molten metal deviating from the sprue of the mold is minimized at the time of allowing the molten metal to flow out. Accordingly, for example, the molten metal flows out from the position, and thus, it is possible to suppress a leakage of the molten metal at the time of pouring.

The control method for the automatic pouring apparatus according to the aspect may further include: controlling the first driving unit such that the discharge port is disposed in an optimal pouring position corresponding to the distance between the discharge port and the center of the sprue in the predetermined direction, in which the total weight of the molten metal flowing into the mold from the ladle is maximized, and controlling the second driving unit such that the ladle is tilted in a state in which the discharge port is maintained in the optimal pouring position.

In the control method for the automatic pouring apparatus according to the aspect, the molten metal flows out from the optimal pouring position corresponding to the distance between the discharge port and the center of the sprue in the predetermined direction, in which the total weight of the molten metal flowing into the mold from the ladle is maximized, and thus, it is possible to minimize the leakage of the molten metal. In addition, pouring is performed in a state where the discharge port is maintained in the optimal pouring position, and thus, it is possible to prevent a vibration from occurring on a fluid level of the molten metal in the ladle while the molten metal is poured. Accordingly, it is possible to prevent a variation from occurring in the dropping position of the molten metal.

In the control method for the automatic pouring apparatus according to the aspect, generating the objective function may include: calculating a temporal change of the flow rate of the molten metal flowing into the mold from the ladle on the basis of the dropping position, the flow velocity of the molten metal in the dropping position, the radius of the sectional surface of the molten metal on the horizontal surface, and the radius of the sprue, the temporal change of the flow rate of the molten metal depending on the distance between the discharge port and the center of the sprue in the predetermined direction, and generating the objective function which is represented by a product of an integral value of the temporal change of the flow rate of the molten metal and the density of the molten metal.

In the control method for the automatic pouring apparatus according to the aspect, a temporal change $Q_{in}(t)$ of the flow rate of the molten metal may be calculated by Expression (1-1) described below, and the objective function is represented by Expression (1-2) described below. In the Expressions (1-1) and (1-2), $S_v$ represents a distance between the discharge port and the dropping position in the predetermined direction, $S_y$ represents the distance between the discharge port and the center of the port in the predetermined direction, $v_l$ represents the flow velocity of the molten metal in the dropping position, $r_l$ represents the radius of the sectional surface of the molten metal on the horizontal surface, $r_s$ represents the radius of the port, q(t) represents the flow rate of the molten metal flowing out from the discharge port, $\Lambda_{in}$ represents an area of a region in which the sprue overlaps with the sectional surface of the molten metal on the horizontal surface, ρ represents the density of the molten metal, and T represents pouring time.

[Expression 1]

$$Q_{in}(t) = \begin{cases} 0, & (|S_y - S_v(t)| - r_l(t) \geq r_s) \\ q(t), & (|S_y - S_v(t)| + r_l(t) \leq r_s) \\ A_{in}(t)v_l(t), & (\text{else}) \end{cases} \quad (1\text{-}1)$$

[Expression 2]

$$W_{in} = \rho \int_0^T Q_{in}(t)dt \quad (1\text{-}2)$$

In another aspect, a control method for an automatic pouring apparatus pouring a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit capable of controlling the first driving unit and the second driving unit and controlling the second driving unit such that the molten metal flows out from the discharge port of the ladle at a predetermined stationary flow rate. The method includes a step of calculating a dropping position of the molten metal on a horizontal surface passing through a height position of the sprue of the mold and a radius of a sectional surface of the molten metal on the horizontal surface, on the basis of a dropping trajectory of the molten metal flowing out from the discharge port at the stationary flow rate, and a step of calculating a distance between the discharge port and the center of the sprue in the predetermined direction, in which a total weight of the molten metal flowing into the mold from the ladle is maximized, on the basis of the dropping position, the radius of the sectional surface of the molten metal on the horizontal surface, and a radius of the sprue.

In another aspect, an automatic pouring apparatus pouring a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit capable of controlling the first driving unit and the second driving unit and controlling the second driving unit such that the molten metal flows out from the discharge port of the ladle at a predetermined stationary flow rate, and the control unit calculates a dropping position of the molten metal on a horizontal surface passing through a height position of the sprue of the mold and a radius of a sectional surface of the molten metal on the horizontal surface, on the basis of a dropping trajectory of the molten metal flowing out from the discharge port at the stationary flow rate, and calculates a distance between the discharge port and the center of the sprue in the predetermined direction, in which a total weight of the molten metal flowing into the mold from the ladle is maximized, on the basis of the dropping trajectory, the radius of the sectional surface of the molten metal on the horizontal surface, and a radius of the sprue.

In another aspect, a control program allowing an automatic pouring apparatus to function to pour a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit capable of controlling the first driving unit and the second driving unit and controlling the second driving unit such that the molten metal flows out from the discharge port of the ladle at a predetermined stationary flow rate. The control program allows the control unit to execute a step of calculating a dropping position of the molten metal on a horizontal surface passing through a height position of the sprue of the mold and a radius of a sectional surface of the molten metal on the horizontal surface, on the basis of a dropping trajectory of the molten metal flowing out from the discharge port at the stationary flow rate, and a step of calculating a distance between the discharge port and the center of the sprue in the predetermined direction, in which a total weight of the molten metal flowing into the mold from the ladle is maximized, on the basis of the dropping position, the radius of the sectional surface of the molten metal on the horizontal surface, and a radius of the sprue.

In another aspect, a computer-readable recording medium storing a control program for allowing an automatic pouring apparatus to function to pour a molten metal into a mold is provided. The automatic pouring apparatus includes a ladle for storing the molten metal, which includes a discharge port for allowing the molten metal to flow out, a first driving unit for moving the ladle along a predetermined direction, in which the predetermined direction extends towards a direction of a connect horizontal component in a direction connecting between the discharge port and a sprue of the mold, a second driving unit for tilting the ladle, and a control unit capable of controlling the first driving unit and the second driving unit and controlling the second driving unit such that the molten metal flows out from the discharge port of the ladle at a predetermined stationary flow rate. The control program allows the control unit to execute a step of calculating a dropping position of the molten metal on a horizontal surface passing through a height position of the sprue of the mold and a radius of a sectional surface of the molten metal on the horizontal surface, on the basis of a dropping trajectory of the molten metal flowing out from the discharge port at the stationary flow rate, and a step of calculating a distance between the discharge port and the center of the sprue in the predetermined direction, in which a total weight of the molten metal flowing into the mold from the ladle is maximized, on the basis of the dropping position, the radius of the sectional surface of the molten metal on the horizontal surface, and a radius of the sprue.

In the control method for an automatic pouring apparatus, the automatic pouring apparatus, the control program, and the computer-readable recording medium storing a control program according to the aspect, the distance between the discharge port and the center of the sprue in the predetermined direction, in which the total weight of the molten metal flowing into the mold from the ladle is maximized, is calculated. The position corresponding to the distance is a position the total weight of the molten metal deviating from the sprue of the mold is minimized at the time of allowing the molten metal to flow out. Accordingly, the molten metal flows out from the position, and thus, it is possible to suppress the leakage of the molten metal at the time of pouring. In addition, in the aspect described above, it is possible to calculate the distance between the discharge port and the center of the sprue in the predetermined direction, in which the total weight of the molten metal flowing into the mold from the ladle is maximized, without solving an optimization problem on the basis of the objective function, and thus, it is possible to speed up processing relevant to the calculation of the distance.

In the aspect, the control method may further include: controlling the first driving unit such that the discharge port is disposed in an optimal pouring position corresponding to the distance between the discharge port and the center of the sprue in the predetermined direction, in which the total weight of the molten metal flowing into the mold from the ladle is maximized, and controlling the second driving unit such that the ladle is tilted in a state in which the discharge port is maintained in the optimal pouring position.

In the aspect, the molten metal flows out from the position corresponding to the distance between the discharge port and the center of the sprue in the predetermined direction, in which the total weight of the molten metal flowing into the mold from the ladle is maximized, and thus, it is possible to minimize the leakage of the molten metal. In addition, pouring is performed in a state where the discharge port is maintained in the optimal pouring position, and thus, it is possible to prevent a vibration from occurring on a fluid level of the molten metal in the ladle while the molten metal is poured. Accordingly, it is possible to prevent a variation from occurring in the dropping position of the molten metal.

In the aspect, a distance $S_{yopt}$ between the discharge port and the center of the sprue in the predetermined direction, in which the total weight of the molten metal flowing into the mold from the ladle is maximized, may be calculated by Expression (1-3) described below. In the Expression (1-3), $S_v$ represents a distance between the discharge port and the dropping position in the predetermined direction, $S_w$ represents a distance between the discharge port and the sprue in a height direction, $r_l$ represents the radius of the sectional surface of the molten metal on the horizontal surface, $r_s$ represents the radius of the sprue, and $q_{st}$ represents the stationary flow rate.

[Expression 3]

$$S_{yopt}=S_v(q_{st},S_w)+r_l(q_{st},S_w)-r_s \quad (1\text{-}3)$$

In the aspect, pouring time from a pouring start time point to a pouring completion time point may be divided into a plurality of time divisions, and the control unit may control the second driving unit such that the molten metal flows out from the discharge port at a first stationary flow rate in a first time division of the plurality of time divisions, and control the second driving unit such that the molten metal flows out from the discharge port of the ladle at a second stationary flow rate in a second time division of the plurality of time divisions, and may calculate the dropping position and the radius of the sectional surface of the molten metal on the horizontal surface, on the basis of the dropping trajectory of the molten metal flowing out from the discharge port at a larger stationary flow rate of the first stationary flow rate and the second stationary flow rate.

According to the aspects and various embodiments of the present invention, it is possible to suppress the leakage of the molten metal at the time of pouring.

DETAILED DESCRIPTION

Figure 1:
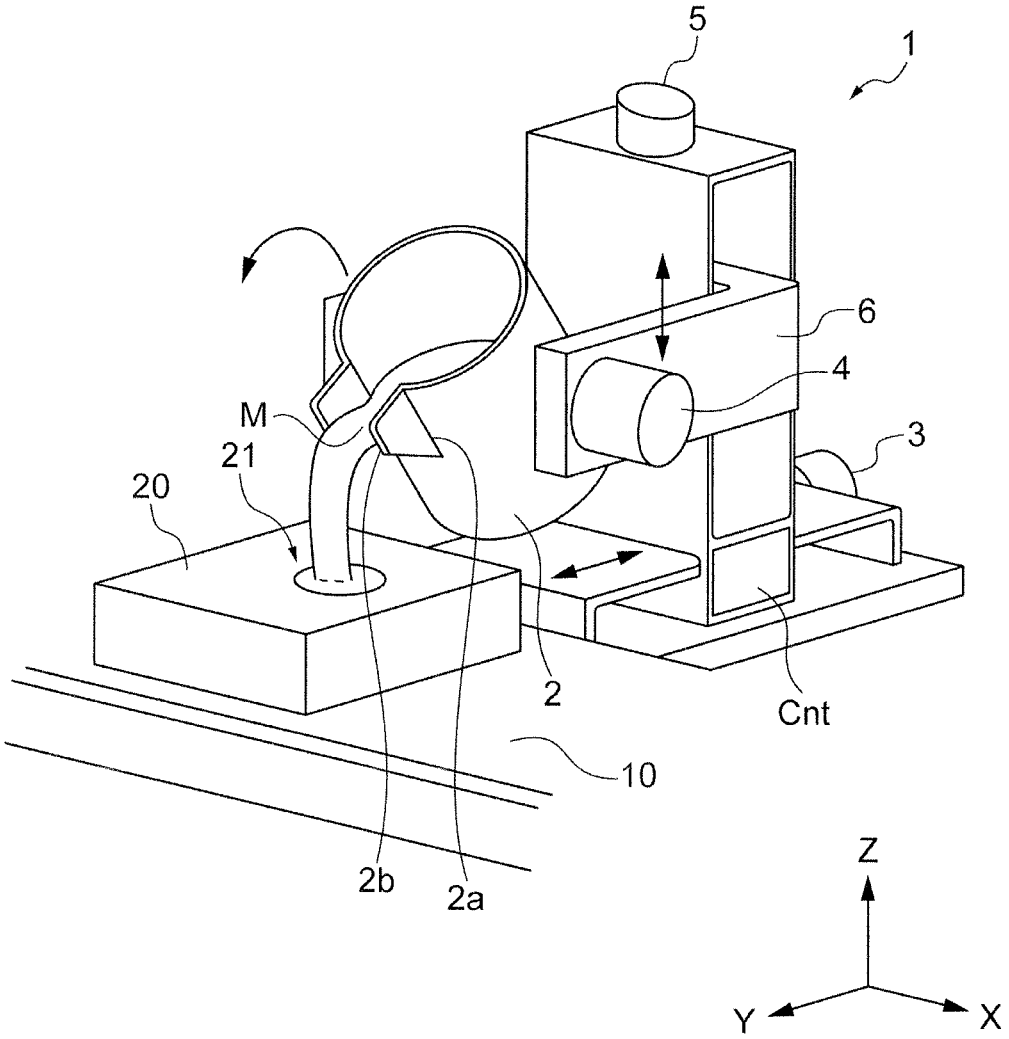
FIG. 1 is a perspective view schematically illustrating an automatic pouring apparatus of an embodiment.

Hereinafter, various embodiments will be described in detail with reference to the drawings. Furthermore, in each of the drawings, the same reference numerals are applied to the same or the corresponding portions.

First, an automatic pouring apparatus according to an embodiment will be described. FIG. 1 is a perspective view schematically illustrating an automatic pouring apparatus 1 according to an embodiment. Hereinafter, as illustrated in FIG. 1, an extending direction of a transporting apparatus described below will be described as an X direction, a vertical direction will be described as a Z direction, and a direction orthogonal to the X direction and the Z direction will be described as a Y direction (a predetermined direction).

As illustrated in FIG. 1, the automatic pouring apparatus 1 includes a ladle 2, a first driving unit 3, a second driving unit 4, a third driving unit 5, and a retaining unit 6. The ladle 2 is a container for storing a molten metal M which is poured into a mold 20. A discharge nozzle 2*a* is disposed on a side upper portion of the ladle 2. A tip portion of the discharge nozzle 2*a* configures a discharge port 2*b*. The ladle 2 is retained by the retaining unit 6 such that the ladle 2 can be tilted around the discharge port 2*b*. In the automatic pouring apparatus 1, the ladle 2 is tilted around the discharge port 2*b*, and thus, the molten metal M flows out from the discharge port 2*b*.

The first driving unit 3, for example, is a servomotor, and generates a driving force for moving the ladle 2 along the Y direction. That is, in a case where the first driving unit 3 is disposed in a position where the discharge port 2*b* of the ladle 2 overlaps with a sprue 21 of the mold 20 in the X direction by the transporting apparatus described below, the first driving unit 3 moves the ladle 2 along a direction extending towards a direction of a horizontal component in a direction connecting between the discharge port 2*b* and the sprue 21. The second driving unit 4, for example, is a servomotor, and generates a driving force for tilting the ladle 2 around the discharge port 2*b*. The third driving unit 5, for example, is a servomotor, and generates a driving force for moving the ladle 2 along the Z direction.

In addition, the automatic pouring apparatus 1 further includes a control unit Cnt. The control unit Cnt is a computer including a processor, a storage unit, and the like, and controls each unit of the automatic pouring apparatus 1. Specifically, the control unit Cnt acquires the position of the ladle 2 in the X direction, the Y direction, and the Z direction, and a tilt angle of the ladle 2 from a sensor or the like disposed in each of the units. In addition, the control unit Cnt transmits a control signal to the first driving unit 3, the second driving unit 4, and the third driving unit 5, and controls the position of the ladle 2 in the Y direction and the Z direction, and the tilt angle of the ladle 2. Furthermore, in the embodiment illustrated in FIG. 1, the control unit Cnt is provided in the main body of the automatic pouring apparatus 1, but the control unit Cnt may be disposed in a position separated from the main body of the automatic pouring apparatus 1.

Figure 2:
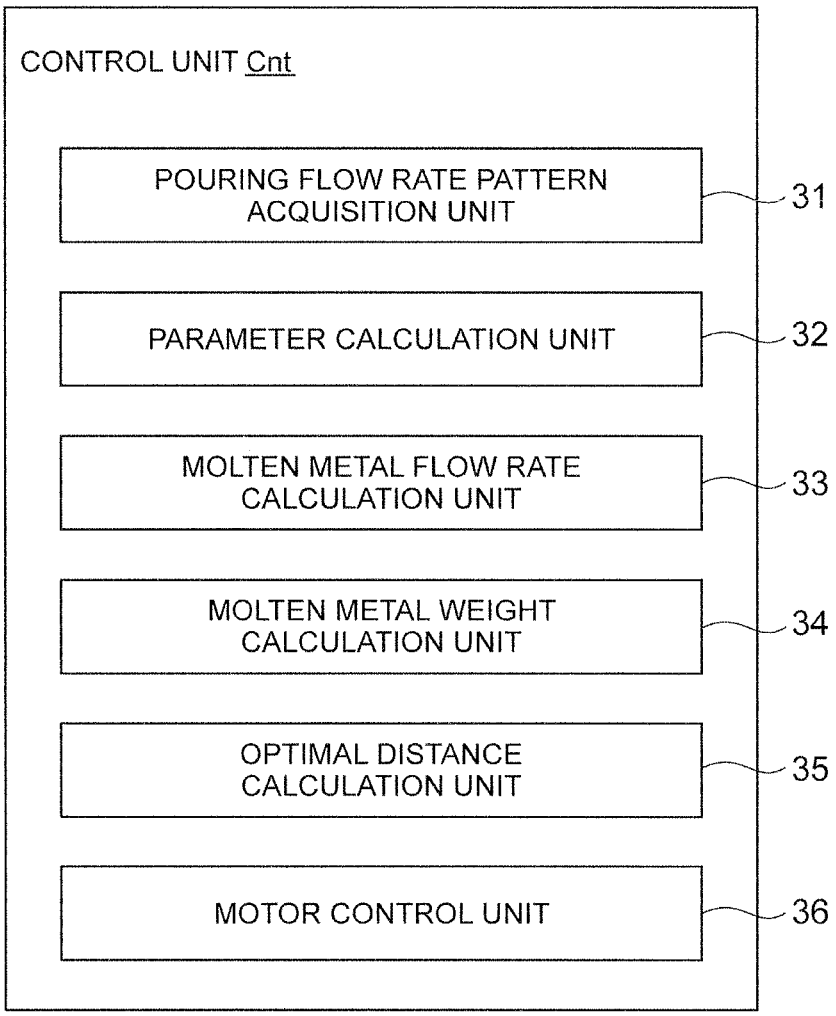
FIG. 2 is a diagram illustrating an example of a functional configuration of a control unit.

As illustrated in FIG. 2, the control unit Cnt includes a pouring flow rate pattern acquisition unit 31, a parameter calculation unit 32, a molten metal flow rate calculation unit 33, a molten metal weight calculation unit 34, an optimal distance calculation unit 35, and a motor control unit 36, as a functional constituent. The pouring flow rate pattern acquisition unit 31 is a functional element acquiring a pouring flow rate pattern described below. The parameter calculation unit 32 is a functional element calculating various parameters for deriving an objective function relevant to the total weight of the molten metal. The molten metal flow rate calculation unit 33 is a functional element for calculating a flow rate of the molten metal M flowing into the mold 20 from the ladle 2. The molten metal weight calculation unit 34 is a functional element calculating the total weight of the molten metal M flowing into the mold 20 from the ladle 2. The optimal distance calculation unit 35 is a functional element calculating a pouring position in which the total weight of the molten metal M flowing into the mold 20 from the ladle 2 is maximized. The motor control unit 36 is a functional element controlling the first driving unit 3, the second driving unit 4, and the third driving unit 5. The details of each functional element of the control unit Cnt will be described below.

In the embodiment, a transporting apparatus 10 can be disposed in front of the automatic pouring apparatus 1. In a pouring step, the transporting apparatus 10 intermittently transports the mold 20, which is disposed on an upper portion of the transporting apparatus 10, along the X direction. In the embodiment, the transporting apparatus 10 transports the mold 20 along the X direction, and stops the mold 20 in the position where the discharge port 2*b* of the ladle 2 overlaps with the sprue 21 of the mold 20 in the X direction. After the mold 20 is stopped in the position, a control method for the automatic pouring apparatus 1 described below is performed.

Figure 3:
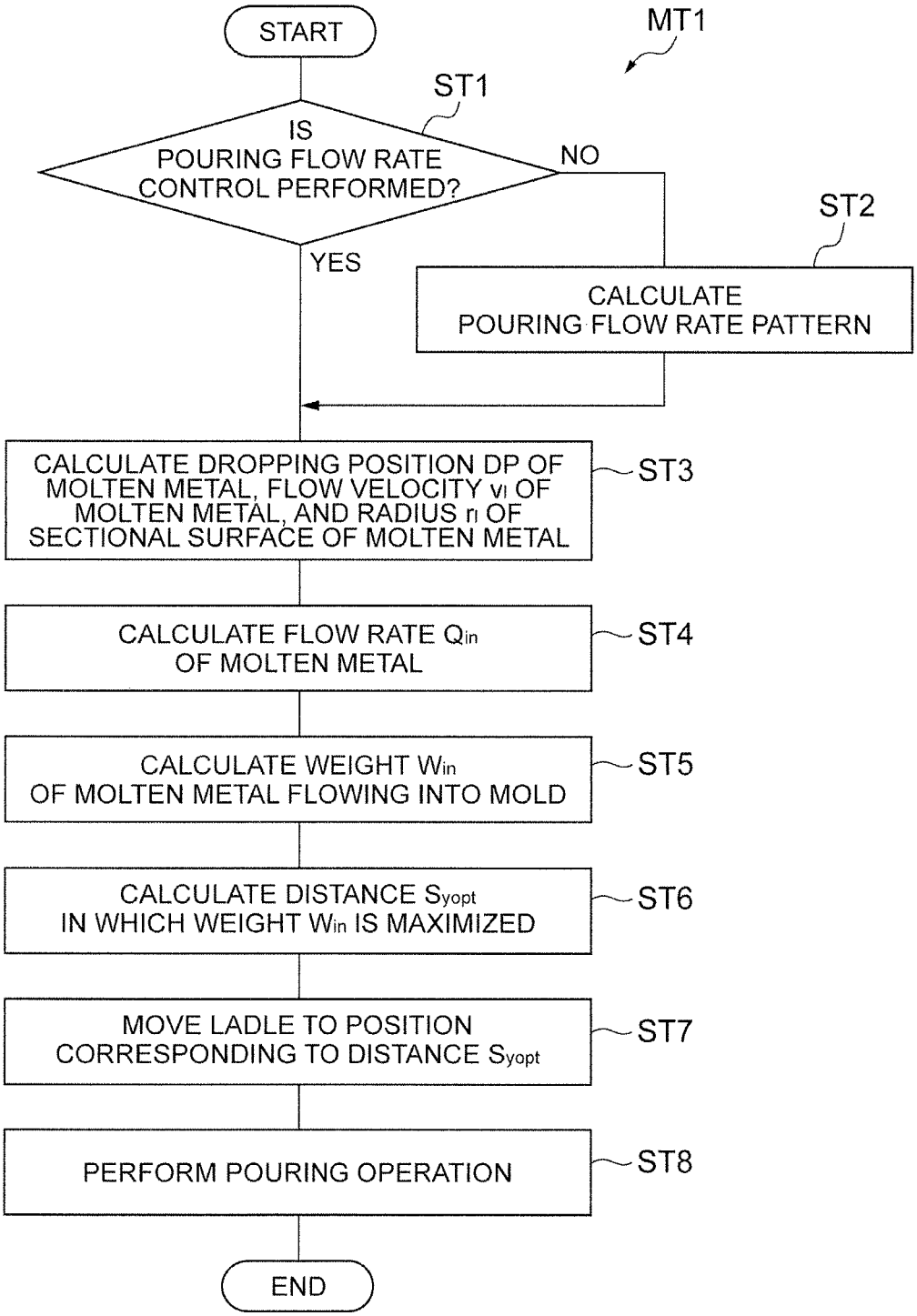
FIG. 3 is a flowchart of a control method for an automatic pouring apparatus of an embodiment.

Next, the function of the control unit Cnt will be described along with a control method for an automatic pouring apparatus of an embodiment. FIG. 3 is a flowchart illustrating a control method for an automatic pouring apparatus of an embodiment. The control unit Cnt performs various operations, and controls each of the units of the automatic pouring apparatus 1, and thus, a control method MT1 of the automatic pouring apparatus illustrated in FIG. 3 can be executed.

In the method MT1 illustrated in FIG. 3, first, Step ST1 is performed. In Step ST1, the pouring flow rate pattern acquisition unit 31 determines whether or not a pouring flow rate control is performed. In the pouring flow rate control, the molten metal M is controlled such that the molten metal M flows out from the ladle 2 at a predetermined flowrate. The pouring flow rate control is performed on the basis of a pouring flow rate pattern stored in advance in the storage unit of the control unit Cnt. The pouring flow rate pattern includes a temporal change in the flow rate of the molten metal M flowing out from the ladle 2 (Hereinafter, also referred to as a "pouring flow rate").

In a case where the pouring flow rate control is not performed, Step ST2 is performed. In Step ST2, the pouring flow rate pattern is calculated from a ladle tilt pattern stored in the storage unit of the control unit Cnt, according to the pouring flow rate pattern acquisition unit 31. The ladle tilt pattern includes a temporal change in the tilt angle of the ladle 2. Hereinafter, a mathematical model for deriving the pouring flow rate pattern from the ladle tilt pattern will be described.

The mathematical model for deriving the pouring flow rate pattern from the ladle tilt pattern is different in a case where the ladle 2 is controlled at an angular velocity $\omega$ [deg/s] and in a case where the ladle 2 is controlled at an angle $\theta$ [deg]. Here, the angle $\theta$ represents the tilt angle of the ladle 2 around the discharge port 2*b* of the ladle 2. The angular velocity $\omega$ represents the tilt angle of the ladle 2 which is rotated per unit time.

Figure 4:
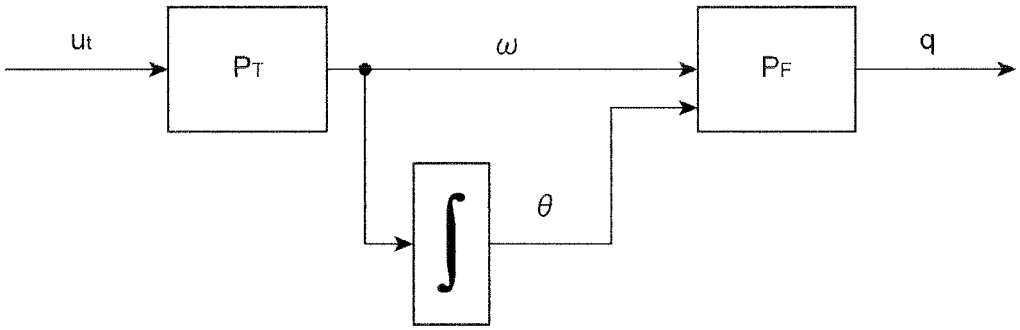
FIG. 4 is a block diagram illustrating processing for deriving a pouring flow rate from a command signal.

First, a case will be described in which the ladle 2 is controlled by the angular velocity $\omega$. In a case where the control unit Cnt controls the ladle 2 at the angular velocity $\omega$, a pouring flow rate q [$m^3/s$] is acquired on the basis of a command signal $u_t$ [V]. The command signal $u_t$ represents a signal which is transmitted to the second driving unit 4 from the control unit Cnt, and for example, is stored in the storage unit of the control unit Cnt. FIG. 4 is a block diagram illustrating processing for deriving the pouring flow rate q from the command signal $u_t$. Here, a relationship between the command signal $u_t$ and the angular velocity ω with respect to the second driving unit 4 is represented as Expression (1) described below. In Expression (1) described below, $T_t$ [s] is a time constant, and $K_t$ [deg/(sV)] is a gain constant.

[Expression 4]

$$\frac{d\omega}{dt} = -\frac{1}{T_t}\omega + \frac{K_t}{T_t}u_t \tag{1}$$

In addition, the angular velocity ω is represented as Expression (2) described below.

[Expression 5]

$$\frac{d\theta}{dt} = \omega \tag{2}$$

On the other hand, in a case where the ladle 2 is controlled by the angle θ, the second driving unit 4 is controlled by the control unit Cnt such that the ladle 2 has a command angle $\theta_r$ [deg] set in advance. For example, the command angle $\theta_r$ is stored in the storage unit of the control unit Cnt. Here, a relationship between the command angle $\theta_r$ and the angular velocity ω with respect to the second driving unit 4 is represented as Expression (3) described below. In Expression (3) described below, $T_t$ is a time constant, and $K_{tp}$ [deg/(sV)] is a gain constant.

[Expression 6]

$$\frac{d\omega}{dt} = -\frac{1}{T_t}\omega + \frac{K_{tp}}{T_t}\theta + \frac{K_{tp}}{T_t}\theta_r \tag{3}$$

Next, the pouring flow rate q is calculated from the angular velocity ω of the ladle 2, on the basis of Expression (4) and Expression (5) described below.

[Expression 7]

$$\frac{dh}{dt} = -\frac{q(h)}{A(\theta)} - \frac{1}{A(\theta)}\left(\frac{\partial A(\theta)}{\partial\theta}h + \frac{\partial V_s(\theta)}{\partial\theta}\right)\omega \tag{4}$$

[Expression 8]

$$q(h) = \int_0^h L_f(h_b)\sqrt{2gh_b}\,dh_b \tag{5}$$

Figure 5:
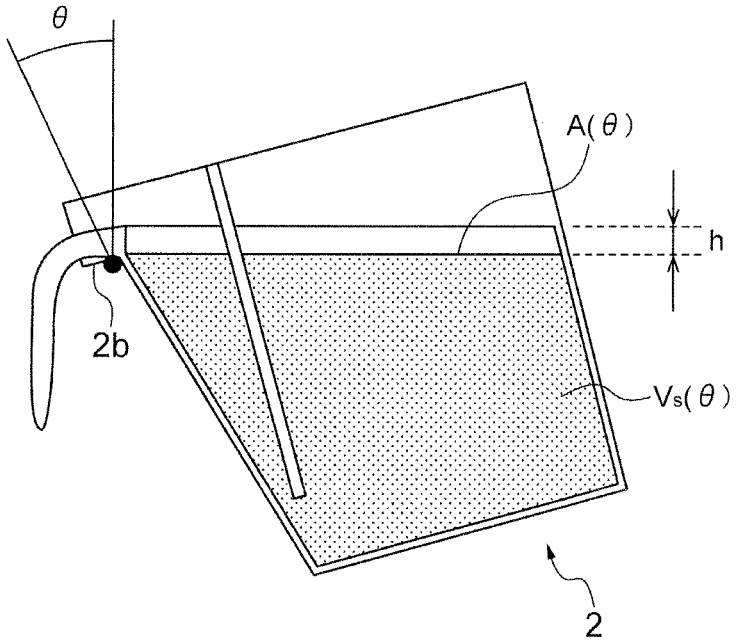
FIG. 5 is a vertical sectional view of a ladle.
Figure 6:
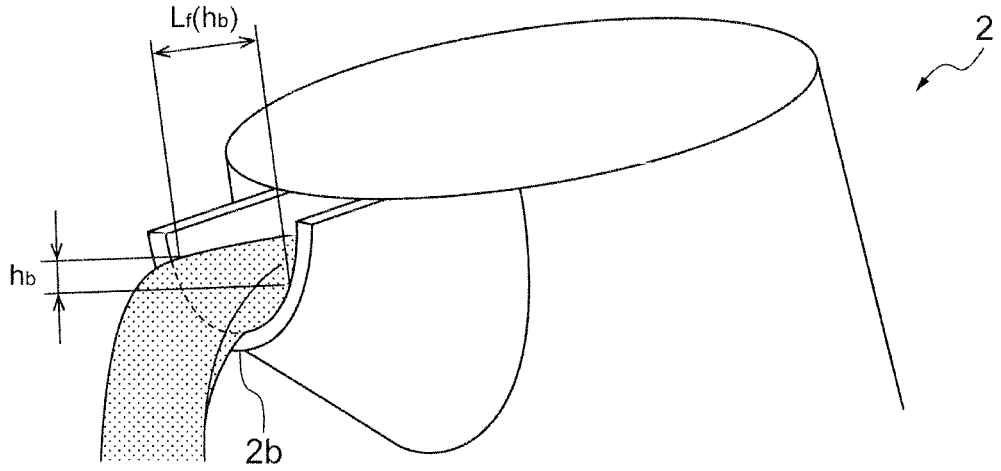
FIG. 6 is a perspective view of a part of the ladle.

Here, as illustrated in FIG. 5, in Expression (4) described above, h [m] represents a height position of a fluid level of the molten metal M based on a height position of the discharge port 2*b*, A(θ) [$m^2$] represents a sectional area of the molten metal M on a horizontal surface passing through the same height position as that of the discharge port 2*b*, and $V_s(\theta)$ [$m^3$] represents the volume of the molten metal M in a position lower than the horizontal surface passing through the same height position as that of the discharge port 2*b*. In addition, as illustrated in FIG. 6, in Expression (5), $h_b$ [m] represents a depth from the fluid level of the molten metal M on a vertical sectional surface passing through the discharge port 2*b*, and $L_f$ [m] represents the width of the discharge port 2*b* in the height position corresponding to $h_b$. In addition, in Expression (5), g [$m/s^2$] represents a gravitational acceleration.

In the method MT1, Step ST3 is performed when it is determined that the pouring flow rate control is performed in Step ST1 or after Step ST2 is executed. In Step ST3, a dropping position DP of the molten metal M on the horizontal surface passing through the height position of the sprue 21 of the mold 20, a flow velocity $v_l$ [m/s] of the molten metal M in the dropping position DP, and a radius $r_l$ [m] of a sectional surface of the molten metal M on the horizontal surface passing through the height position of the sprue 21 are calculated on the basis of a dropping trajectory of the molten metal M flowing out from the discharge port 2*b*, according to the parameter calculation unit 32.

In Step ST3, first, the dropping trajectory of the molten metal M flowing out from the ladle 2 is derived. In order to derive the dropping trajectory of the molten metal M, first, an average flow velocity $V_f$ [m/s] of the molten metal M in the discharge port 2*b* of the ladle 2 is calculated by Expression (6) described below.

[Expression 9]

$$V_f = \frac{q(h)}{A_p(h)} \tag{6}$$

Here, in Expression (6) described above, $A_p$ [$m^2$] represents the sectional area of the molten metal M on the vertical sectional surface passing through the discharge port 2*b* of the ladle 2. The sectional area $A_p$ is represented by Expression (7) described below.

[Expression 10]

$$A_p(h)=\int_0^h L_f(h_b)dh_b \tag{7}$$

Figure 7:
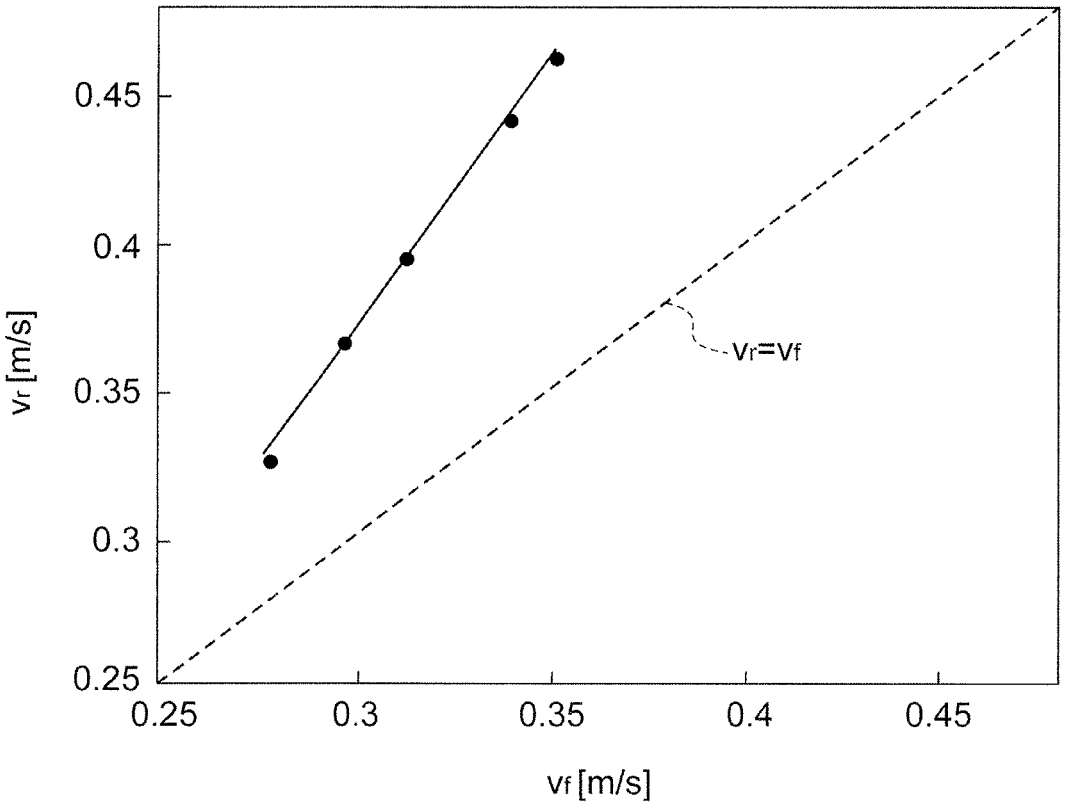
FIG. 7 is a graph illustrating a relationship between an average flow velocity of a molten metal calculated on the basis of Expression (6) and the average flow velocity of the molten metal measured by an experiment.
Figure 8:
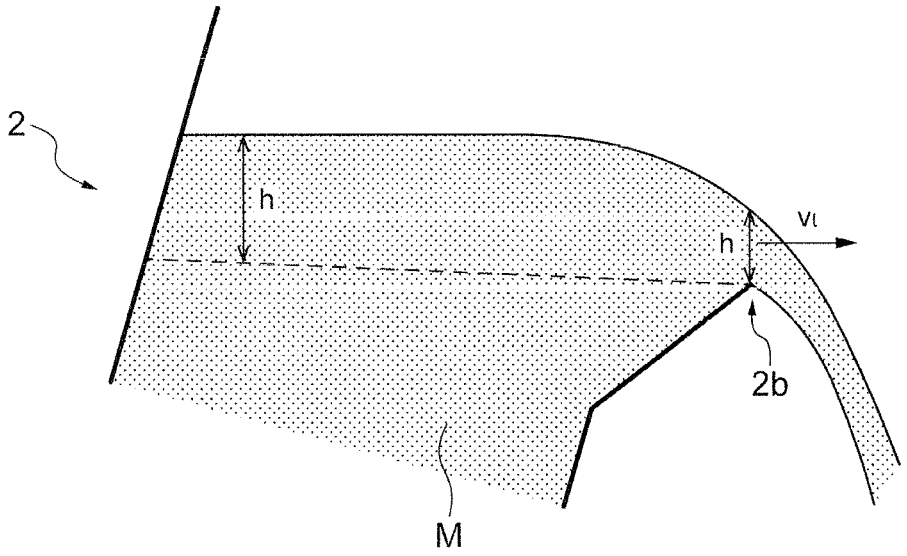
FIG. 8 is a diagram for illustrating a fluid level height of the molten metal.

Here, FIG. 7 is a graph illustrating a relationship between the average flow velocity $V_f$ of the molten metal M calculated on the basis of Expression (6) described above and the average flow velocity $v_r$ [m/s] of the actual molten metal M measured by an experiment. In FIG. 7, a horizontal axis represents the average flow velocity $V_f$ of the molten metal M calculated on the basis of Expression (6) described above, and a vertical axis represents the average flow velocity $v_r$ of the molten metal M obtained by the experiment. As illustrated in FIG. 7, the actual average flow velocity $v_r$ of the molten metal M flowing out from the discharge port 2*b* is faster than the average flow velocity $V_f$ [m/s] calculated by Expression (6) described above. As a result thereof, in a case where the molten metal M actually flows out from the discharge port 2*b*, as illustrated in FIG. 8, it is considered that this is because the height position of the fluid level of the molten metal M in the discharge port 2*b* is lower than the height position of the fluid level of the molten metal M in a position separated from the discharge port 2*b* due to an influence of a gravitational force.

Therefore, in Step ST3, the theoretical value of the average flow velocity of the molten metal M is corrected as represented in Expression (8) described below such that a theoretical value of the average flow velocity of the molten metal M is coincident with an actual measured value. Here, in Expression (8), $v_t$ [m/s] is an average flow velocity after being corrected, and $\alpha_1$ and $\alpha_0$ are coefficients which are obtained by approximating the average flow velocity $V_f$ obtained by a simulation and the actual measured value $v_r$ of the average flow velocity with a least-square method. In the embodiment where the result illustrated in FIG. 7 is obtained, $\alpha_1$ is set to 2.067, and $\alpha_0$ is set to −0.275.

[Expression 11]

$$v_t=\alpha_1 v_f+\alpha_0 \tag{8}$$

Figure 9:
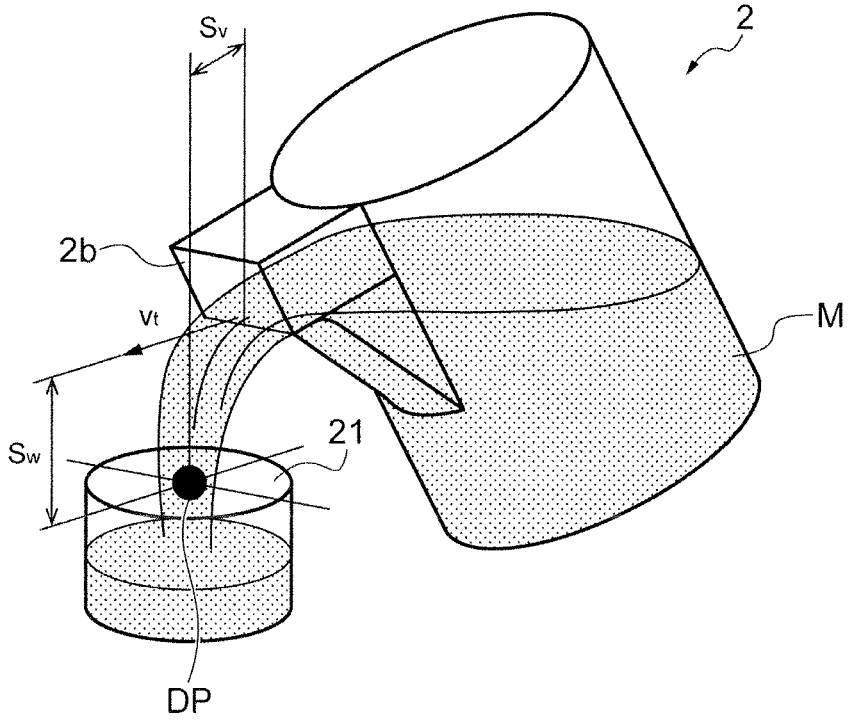
FIG. 9 is a diagram for illustrating a positional relationship between a discharge port and a port.
Figure 10:
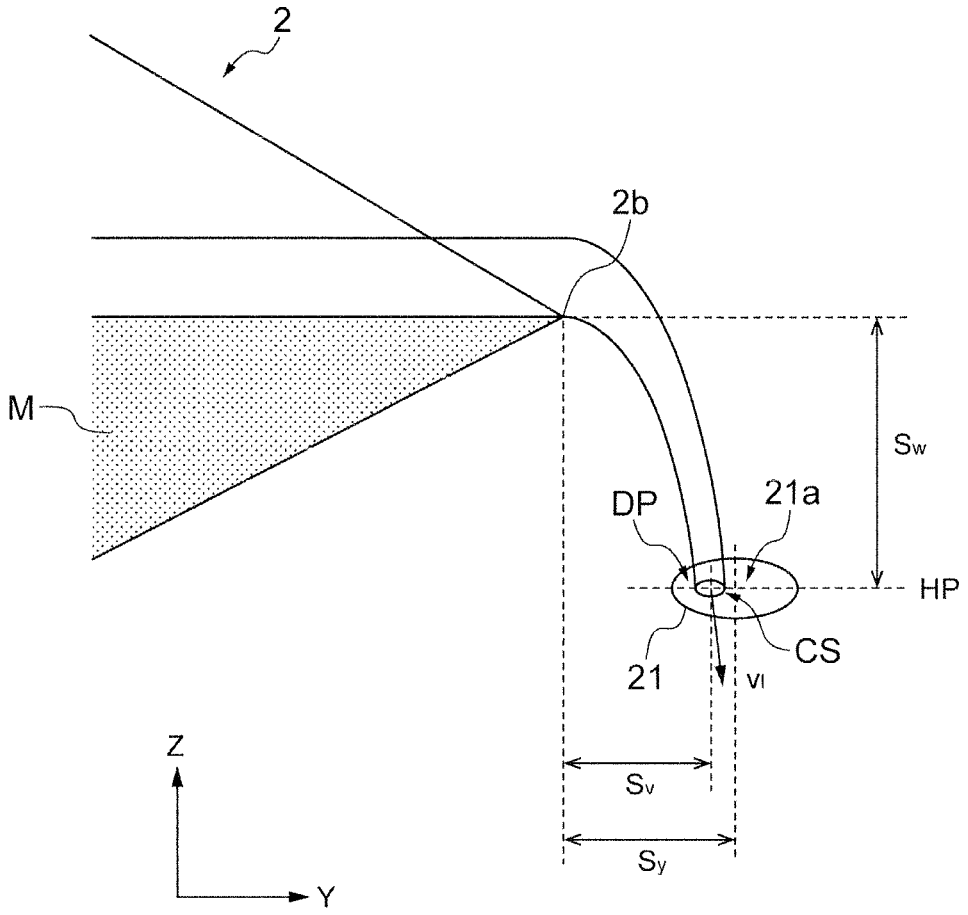
FIG. 10 is a diagram for illustrating the positional relationship between the discharge port and the sprue.

Next, the dropping position DP of the molten metal M on a horizontal surface HP passing through the height position of the sprue 21 is derived. Here, as illustrated in FIG. 9 and FIG. 10, in a case where a distance between the discharge port 2*b* of the ladle 2 and the dropping position DP in the Y direction is set to $S_v$ [m], and a distance between the discharge port 2*b* of the ladle 2 and the sprue 21 of the mold 20 in the Z direction is set to $S_w$ [m], the molten metal M flowing out from the discharge port 2*b* has a free-dropping motion, and thus, the distance $S_v$ is represented as Expression (9) described below.

[Expression 12]

$$S_v = v_t\sqrt{\frac{2S_w}{g}} \tag{9}$$

The dropping position DP of the molten metal M on the horizontal surface HP is derived from the distance $S_v$ calculated by Expression (9) described above.

Next, a flow velocity $v_g$ of the molten metal M in the dropping position DP in the Z direction is calculated by Expression (10) described below.

[Expression 13]

$$v_g=\sqrt{2gS_w} \tag{10}$$

Next, the flow velocity $v_l$ of the molten metal M in the dropping position DP is calculated by Expression (11) described below.

[Expression 14]

$$v_l=\sqrt{v_t^2+v_g^2} \tag{11}$$

Here, in a case where it is assumed that the sectional surface of the molten metal M dropping freely in the height position of the sprue 21 is in the shape of a circle, an area $A_l$ [m$^2$] of a sectional surface CS of the molten metal M on the horizontal surface HP is represented as Expression (12) described below.

[Expression 15]

$$A_l(t) = \frac{q(t)}{v_l(t)} \tag{12}$$

In addition, the radius $r_l$ [m] of the sectional surface CS of the molten metal M on the horizontal surface HP is represented by Expression (13) described below.

[Expression 16]

$$r_l(t) = \sqrt{\frac{A_l(t)}{\pi}} \tag{13}$$

Next, in the method MT1, Step ST4 is performed. In Step ST4, a flow rate $Q_{in}$ of the molten metal M flowing into the mold 20 from the ladle 2 is calculated, according to the molten metal flow rate calculation unit 33. The flow rate $Q_{in}$ is represented as Expression (1-1) described below, on the basis of the distance $S_v$ between the discharge port 2*b* of the ladle 2 and the dropping position DP in the Y direction, the flow velocity $v_l$ of the molten metal M, the radius $r_l$ of the sectional surface CS of the molten metal M, and the radius $r_s$ of the sprue 21, which are calculated in Step ST3.

[Expression 17]

$$Q_{in}(t) = \begin{cases} 0, & (|S_y - S_v(t)| - r_l(t) \geq r_s) \\ q(t), & (|S_y - S_v(t)| + r_l(t) \leq r_s) \\ A_{in}(t)v_l(t), & (\text{else}) \end{cases} \tag{1-1}$$

Figure 11:
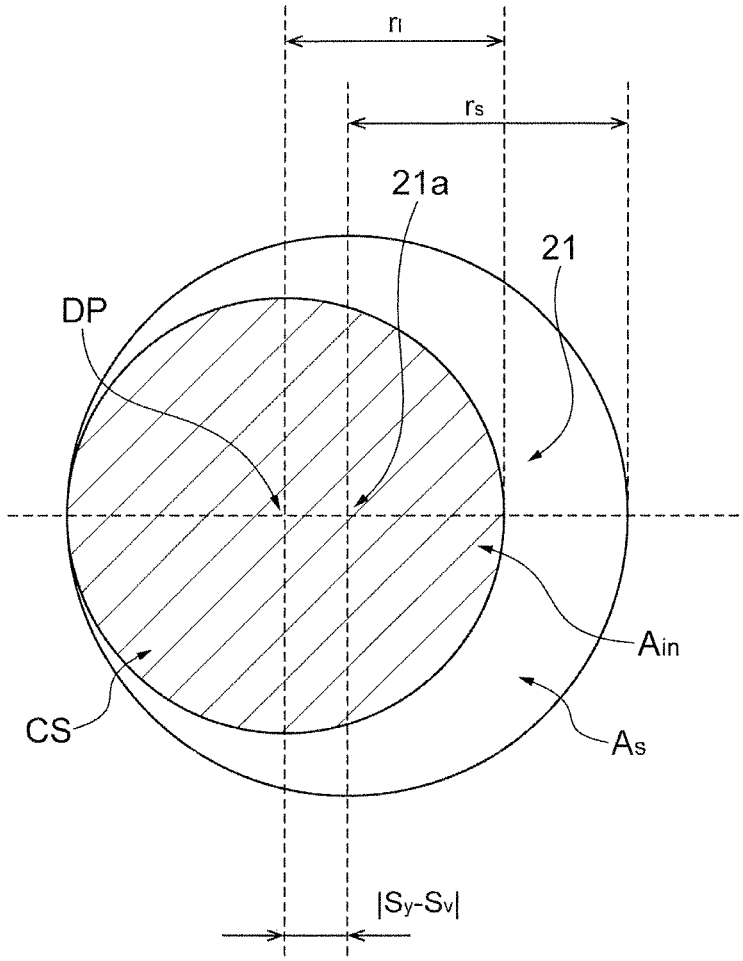
FIG. 11 is a diagram illustrating a positional relationship between the sprue and a sectional surface of the molten metal on a horizontal surface.

Here, as illustrated in FIG. 11, in Expression (1-1), $A_{in}(t)$ [m$^2$] represents an area of a region in which the sprue 21 overlaps with the sectional surface CS of the molten metal M in the dropping position DP on the horizontal surface HP, in the plan view from the Z direction. The area $A_{in}(t)$ is geometrically calculated from the distance $S_v$ between the discharge port 2*b* and the dropping position DP in the Y direction, a distance $S_y$ between the discharge port 2*b* and the center 21*a* of the sprue 21 in the Y direction, the radius $r_s$ of the sprue 21, and the radius $r_l$ of the sectional surface of the molten metal M on the horizontal surface HP. In Expression (1-1), the flow rate $Q_{in}$ of the molten metal M is a function depending on the distance $S_y$.

Next, in the method MT1, Step ST5 is performed. In Step ST5, a function relevant to a total weight $W_{in}$ [kg] of the molten metal M flowing into the mold 20 from the ladle 2 is generated, according to the molten metal weight calculation unit 34. As represented in Expression (1-2) described below, the total weight $W_{in}$ of the molten metal M is represented as a product between an integral value of the flow rate $Q_{in}$ of the molten metal M which is changed over time and a density ρ of the molten metal M. In Expression (1-2), T represents pouring time from a pouring start time point to a pouring end time point.

[Expression 18]

$$W_{in}=\rho\int_0^T Q_{in}(t)dt \tag{1-2}$$

Next, in the method MT1, Step ST6 is performed. In Step ST6, a distance $S_{yopt}$ between the discharge port 2*b* and the center of the sprue 21 in the Y direction, in which the total weight $W_{in}$ of the molten metal M flowing into the mold 20 from the ladle 2 is maximized, is calculated, according to the optimal distance calculation unit 35. As represented in Expression (14) described below, the distance $S_{yopt}$ is obtained by solving an optimization problem of a single variable in which Expression (1-2) is used as the objective function. Such an optimization problem of the objective function, for example, can be solved by using a bisection method or a golden section method.

[Expression 19]

$$S_{yopt}=\arg\max(W_{in}) \tag{14}$$

Next, in the method MT1, Step ST7 is performed. In Step ST7, the motor control unit 36 controls the first driving unit 3, and thus, the ladle 2 is moved such that the discharge port 2*b* is disposed in a position (an optimal pouring position) corresponding to the distance $S_{yopt}$.

Next, in the method MT1, Step ST8 is performed. In Step ST8, a pouring operation is performed. Specifically, the motor control unit 36 transmits the control signal to the second driving unit 4, and the ladle 2 is tilted by a predetermined angle in a state where the discharge port 2*b* of the ladle 2 is maintained in the position corresponding to the distance $S_{yopt}$. Accordingly, the molten metal flows out from the discharge port 2*b* of the ladle 2, and the flowed-out molten metal flows into the mold 20 through the sprue 21. In a case where the pouring time set in advance elapses, the control method MT1 of the automatic pouring apparatus of the embodiment is ended.

As described above, in the method MT1, the distance $S_{yopt}$ between the discharge port 2*b* and the center of the sprue 21 in the Y direction, in which the total weight $W_{in}$ of the molten metal M flowing into the mold 20 is maximized, is calculated. Then, the molten metal M flows out from the position corresponding to the distance $S_{yopt}$, and thus, it is possible to minimize the leakage of the molten metal.

Figure 12:
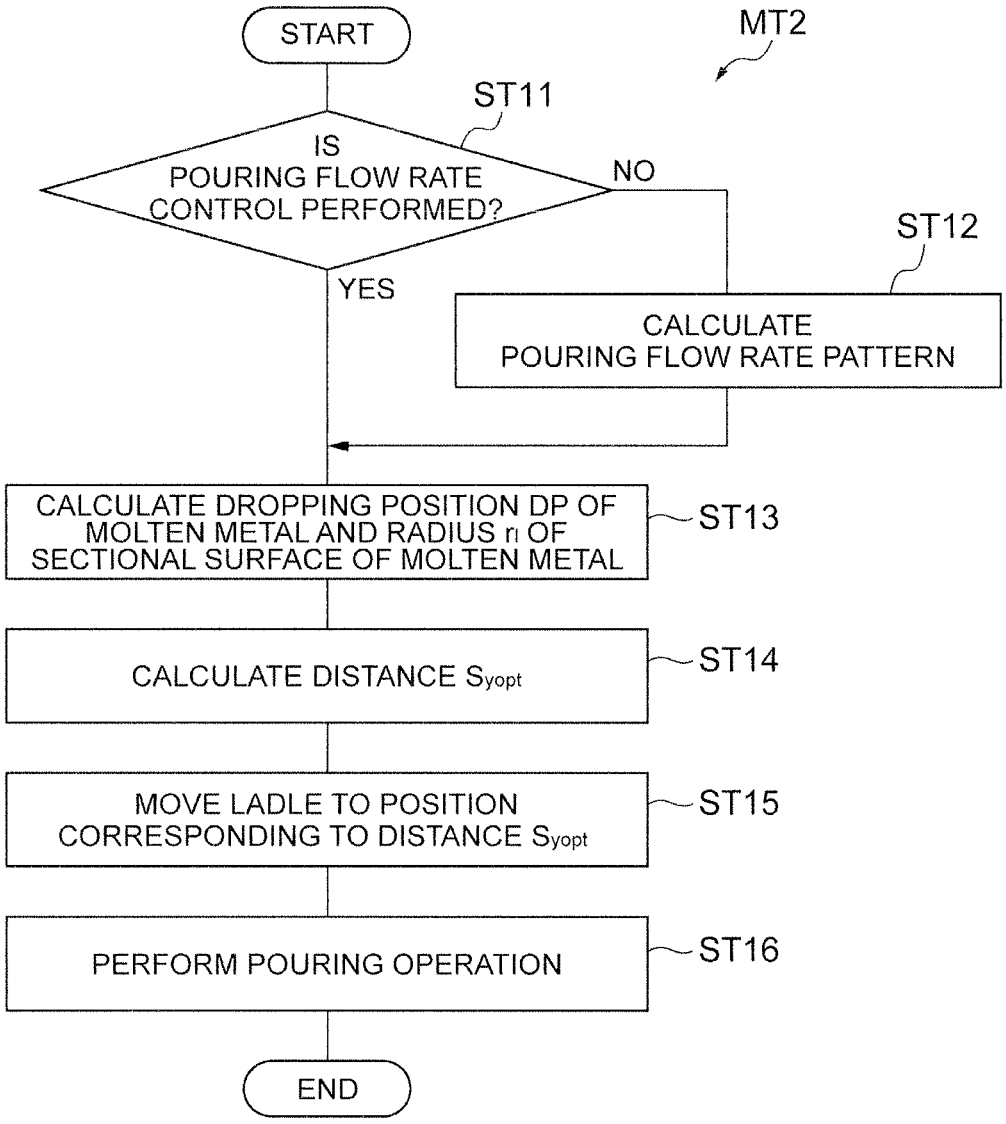
FIG. 12 is a flowchart illustrating a control method for an automatic pouring apparatus of another embodiment.

Next, another control method for the automatic pouring apparatus 1 will be described. FIG. 12 is a flowchart illustrating a control method MT2 of the automatic pouring apparatus 1 according to another embodiment. The method MT2 is a control method for the automatic pouring apparatus 1, which is executed in a case where the pouring flow rate from the ladle 2 is a stationary flow rate. Hereinafter, it will be described that the control unit Cnt controls the second driving unit 4 such that the molten metal M flows out from the discharge port 2*b* of the ladle 2 at the predetermined stationary flow rate.

Step ST11 and Step ST12 of the method MT2 are respectively identical to Step ST1 and ST2 of the method MT1, and thus, the description thereof will be omitted. In the method MT2, Step ST13 is performed after Step ST12 is executed. In Step ST3, the dropping position DP of the molten metal M on the horizontal surface passing through the height position of the sprue 21 of the mold 20 and the radius $r_l$ [m] of the sectional surface of the molten metal M on the horizontal surface passing through the height position of the sprue 21 are calculated on the basis of the dropping trajectory of the molten metal M flowing out from the discharge port 2*b*. A calculation method of the dropping position DP and the radius $r_l$ of the sectional surface of the molten metal M is identical to the method described in Step ST3 of the method MT1, and thus, the description thereof will be omitted.

Next, in the method MT2, Step ST14 is performed. In Step ST14, the distance $S_{yopt}$ between the discharge port 2*b* and the center of the sprue 21 in the Y direction, in which the total weight $W_{in}$ of the molten metal M flowing into the mold 20 is maximized, is calculated. In the method MT2, as represented in Expression (1-3) described below, the distance $S_{yopt}$ is calculated on the basis of the distance $S_v$ between the discharge port 2*b* and the dropping position DP in the Y direction, distance $S_w$ between the discharge port 2*b* and the sprue 21 in the Y direction, the radius $r_s$ of the sprue 21, and the stationary flow rate $q_{st}$ [$m^3$/s].

[Expression 20]

$$S_{yopt}=S_v(q_{st},S_w)+r_l(q_{st},S_w)-r_s \tag{1-3}$$

Furthermore, the pouring time from the pouring start time point to the pouring completion time point may be divided into a plurality of time divisions, and the second driving unit 4 may be controlled such that the molten metal M flows out from the discharge port 2*b* at a first stationary flow rate in a first time division of the plurality of time divisions, and the molten metal M flows out from the discharge port 2*b* of the ladle 2 at a second stationary flow rate in a second time division of the plurality of time divisions. In this case, as represented in Expression (15) described below, the control unit Cnt is capable of calculating the distance $S_v$ between the discharge port 2*b* and the dropping position DP in the Y direction and the radius $r_l$ of the sectional surface of the molten metal M, on the basis of the dropping trajectory of the molten metal M flowing out from the discharge port 2*b* at a larger stationary flow rate $q_{stmax}$ [$m^3$/s] of the first stationary flow rate and the second stationary flow rate.

[Expression 21]

$$S_{yopt}=S_v(q_{stmax},S_w)+r_l(q_{stmax},S_w)-r_s \tag{15}$$

Next, in the method MT2, Step ST15 is performed. In Step ST15, the motor control unit 36 controls the first driving unit 3, and thus, the ladle 2 is moved such that the discharge port 2*b* is disposed in the position corresponding to the distance $S_{yopt}$.

Next, in the method MT2, Step ST16 is performed. In Step ST16, the pouring operation is performed. Specifically, the motor control unit 36 transmits the control signal to the second driving unit 4, and the ladle 2 is tilted by a predetermined angle in a state where the discharge port 2*b* of the ladle 2 is maintained in the position corresponding to the distance $S_{yopt}$ in the Y direction. Accordingly, the molten metal flows out from the discharge port 2*b* of the ladle 2, and the flowed-out molten metal flows into the mold 20 through the sprue 21. In a case where the pouring time set in advance elapses, the control method MT2 of the automatic pouring apparatus of the embodiment is ended.

In the method MT2 described above, when the distance $S_{yopt}$ is calculated, it is not necessary to solve the optimization problem represented in Expression (14), and thus, it is possible to simplify the operation. Accordingly, it is possible to speed up the calculation of the distance $S_{yopt}$.

Next, a control program allowing the automatic pouring apparatus 1 to function to pour the molten metal into the mold will be described. The control unit program is executed in the control unit Cnt.

The control program includes a main module, a pouring flow rate pattern acquisition module, a parameter calculation module, a molten metal flow rate calculation module, a molten metal weight calculation module, an optimal distance calculation module, and a motor control module.

The main module is a portion integrally controlling the automatic pouring apparatus 1. Each function realized by executing the pouring flow rate pattern acquisition module, the parameter calculation module, the molten metal flow rate calculation module, the molten metal weight calculation module, the optimal distance calculation module, and the motor control module in the control unit Cnt is identical to each of the functions of the pouring flow rate pattern acquisition unit 31, the parameter calculation unit 32, the molten metal flow rate calculation unit 33, the molten metal weight calculation unit 34, the optimal distance calculation unit 35, and the motor control unit 36, described above.

The control unit program, for example, is provided in a state of being recorded in a recording medium such as a CD-ROM, a DVD, or an ROM, or a semiconductor memory. In addition, the control unit program may be provided through a communication network.

Hereinafter, the present invention will be described in more detail on the basis of experimental examples, but the present invention is not limited to the following experimental examples.

Figure 13A:
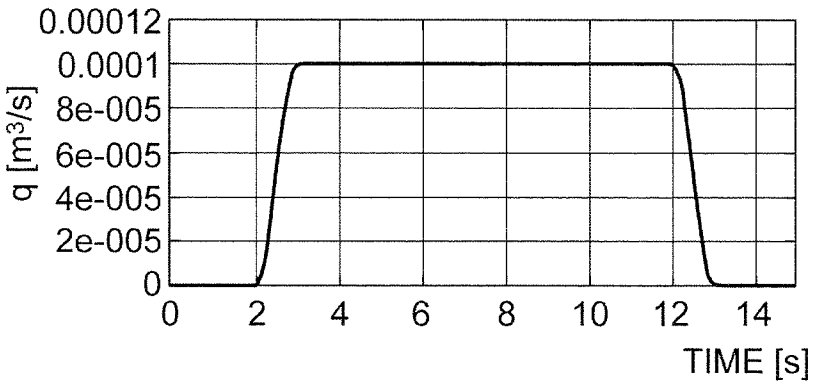
FIGS. 13A to 13D are graphs illustrating a pouring flow rate used in Experimental Example 1 and Experimental Example 2.
Figure 13B:
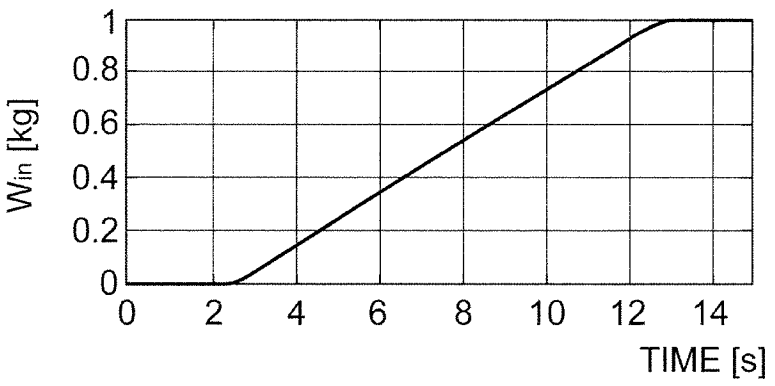
Figure 13C:
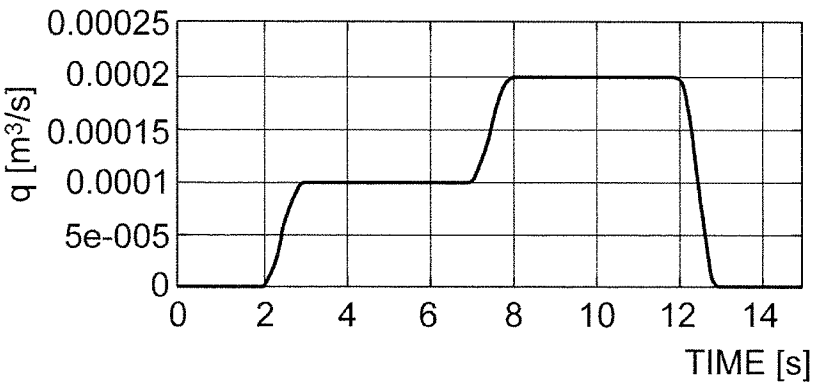
Figure 13D:
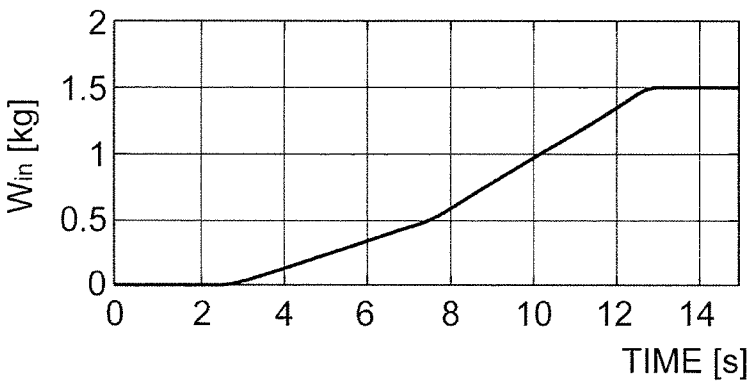

FIG. 13A is a graph illustrating the pouring flow rate q used in Experimental Example 1. As illustrated in FIG. 13A, in Experimental Example 1, the molten metal M flows out from the ladle 2 at a stationary flow rate of $1.0\times10^{-4}$ [$m^3$/s]. FIG. 13B is a graph illustrating a temporal change in the total weight $W_{in}$ of the molten metal M flowing out from the ladle 2 in Experimental Example 1. FIG. 13C is a graph illustrating the pouring flow rate q used in Experimental Example 2. As illustrated in FIG. 13C, in Experimental Example 2, the molten metal M flows out from the ladle 2 at a stationary flow rate of $1.0\times10^{-4}$ [$m^3$/s] in the first time division (that is, a time division from 3 seconds to 7 seconds), and the molten metal M flows out from the ladle 2 at a stationary flow rate of $2.0\times10^{-4}$ [$m^3$/s] in the second time division (that is, a time division from 8 seconds to 12 seconds) after the first time division. FIG. 13D is a graph illustrating a temporal change in the total weight of the molten metal M flowing out from the ladle 2 in Experimental Example 2. In Experimental Example 1 and Experimental Example 2, the distance $S_w$ between the discharge port 2*b* and the sprue 21 in the Z direction at the time of pouring is set to 0.20 [m], and the radius $r_s$ of the sprue 21 is set to 0.03 [m].

Figure 14A:
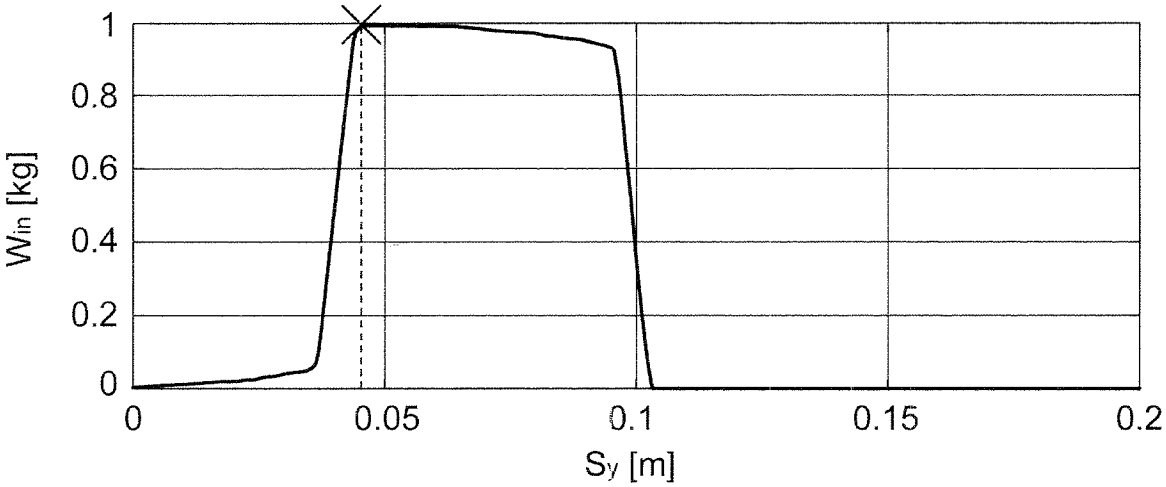
FIGS. 14A and 14B are simulation results representing a relationship between a distance between the discharge port and the center of the sprue in a Y direction, and a total weight of a molten metal M.
Figure 14B:
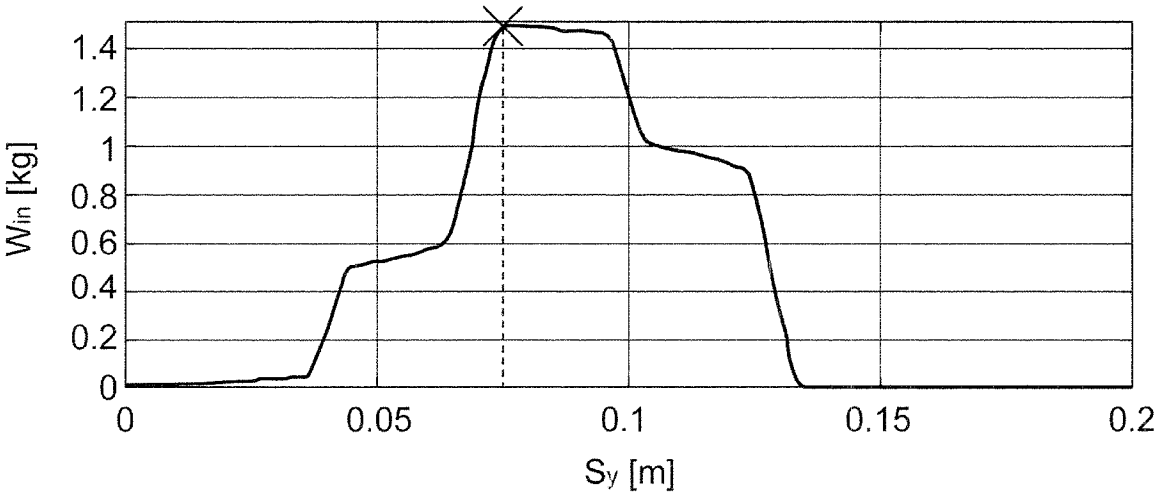

Next, refer to FIGS. 14A and 14B. FIGS. 14A and 14B are simulation results representing a relationship between the distance $S_y$ between the discharge port 2*b* and the center of the sprue 21 in the Y direction, and the total weight $W_{in}$ of the molten metal M flowing into the mold 20 from the ladle 2, which is calculated by using Expression (1-2) described above. FIG. 14A is a simulation result of Experimental Example 1, and FIG. 14B is a simulation result of Experimental Example 2.

As illustrated in FIG. 14A and FIG. 14B, it is confirmed that the total weight $W_{in}$ of the molten metal M depends on the distance $S_y$. A mark x illustrated in FIG. 14A and FIG. 14B represents the maximum value of the total weight $W_{in}$ of the molten metal M. The distance $S_y$ corresponding to the maximum value of the total weight $W_{in}$ represents the distance $S_{yopt}$ between the discharge port 2*b* and the center of the sprue 21 in the Y direction, in which the total weight $W_{in}$ of the molten metal M is maximized. As illustrated in FIGS. 14A and 14B, the distance $S_{yopt}$ is 0.044 [m] in Experimental Example 1, and the distance $S_{yopt}$ is 0.075 [m] in Experimental Example 2.

Figure 15A:
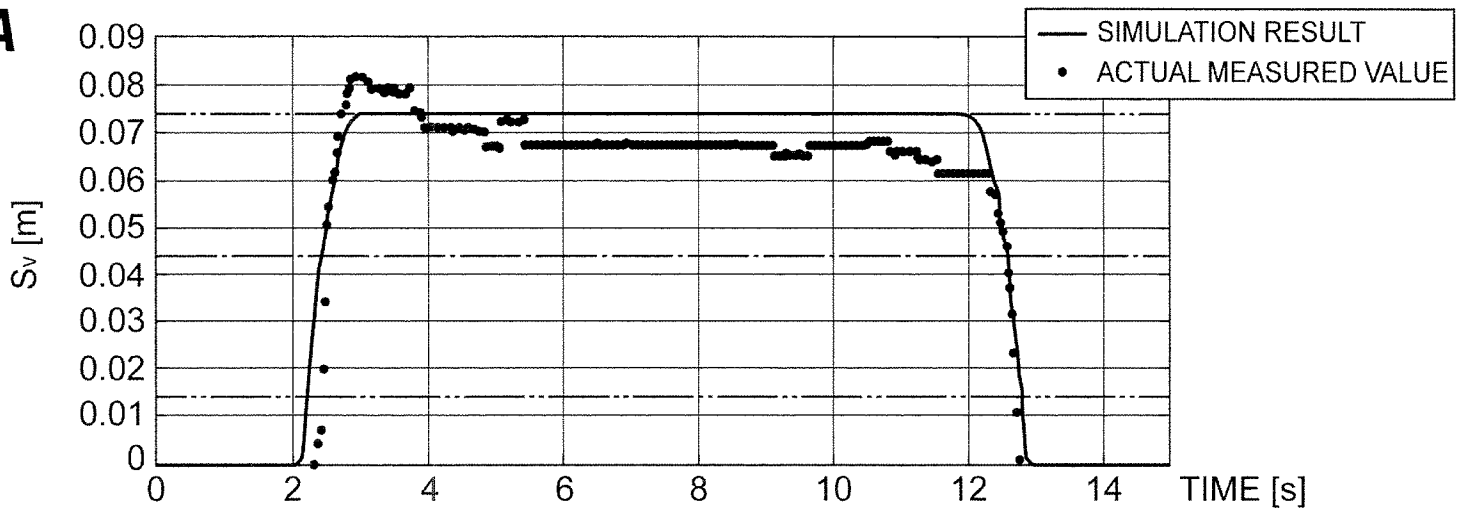
FIGS. 15A and 15B are graphs illustrating a temporal change in a distance between the discharge port and a dropping position in the Y direction.
Figure 15B:
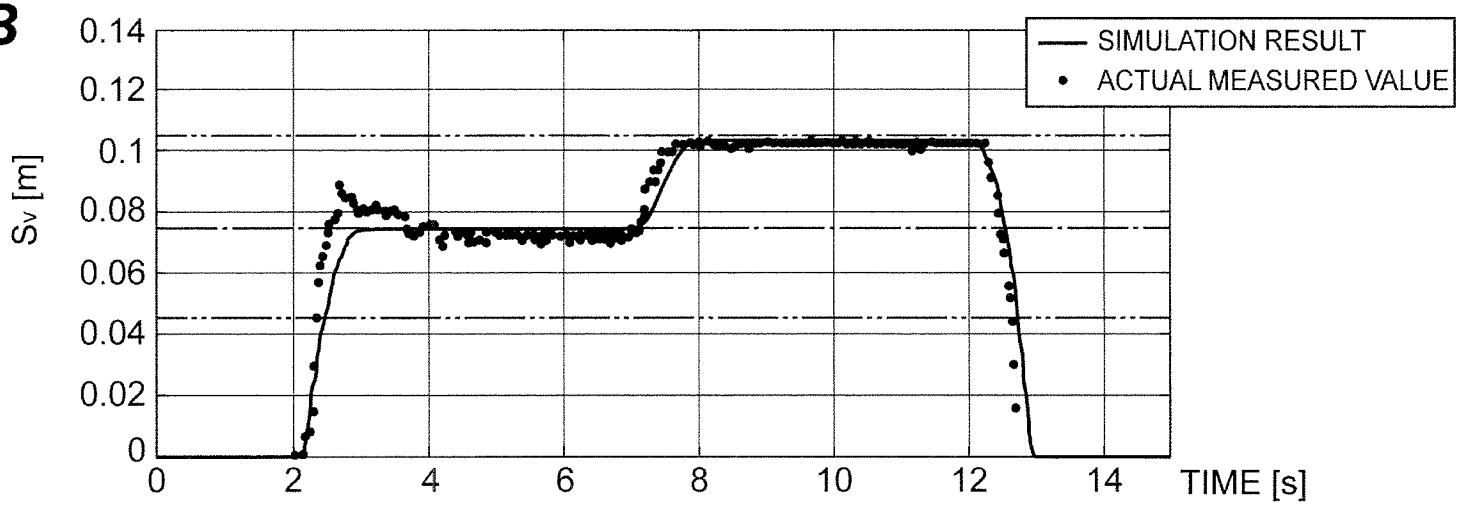

FIG. 15A is a graph illustrating a temporal change in the distance $S_v$ between the discharge port 2*b* and the dropping position DP in the Y direction when the molten metal M flows out from the position corresponding to the distance $S_{yopt}$ in Experimental Example 1. FIG. 15B is a graph illustrating a temporal change in the distance $S_v$ between the discharge port 2*b* and the dropping position DP in the Y direction when the molten metal M flows out from the position corresponding to the distance $S_{yopt}$ in Experimental Example 2. In FIG. 15A and FIG. 15B, a horizontal axis represents time, and a vertical axis represents the distance $S_v$. In FIG. 15A and FIG. 15B, a dashed-dotted line represents a center position of the sprue 21 based on the discharge port 2*b* in the Y direction, and a dashed-two dotted line represents the position of the edge of the sprue 21 based on the discharge port 2*b* in the Y direction. In addition, in FIG. 15A and FIG. 15B, a solid line represents a simulation result of the distance $S_v$, which is calculated by using Expression (9) described above, and a dotted line represents the distance $S_v$ which is actually measured in each of Experimental Example 1 and Experimental Example 2.

From the results illustrated in FIG. 15A and FIG. 15B, it is confirmed that the molten metal M drops from the position corresponding to the distance $S_{yopt}$, and thus, most of the molten metal M flows into the mold 20 from the ladle 2.

Figure 16A:
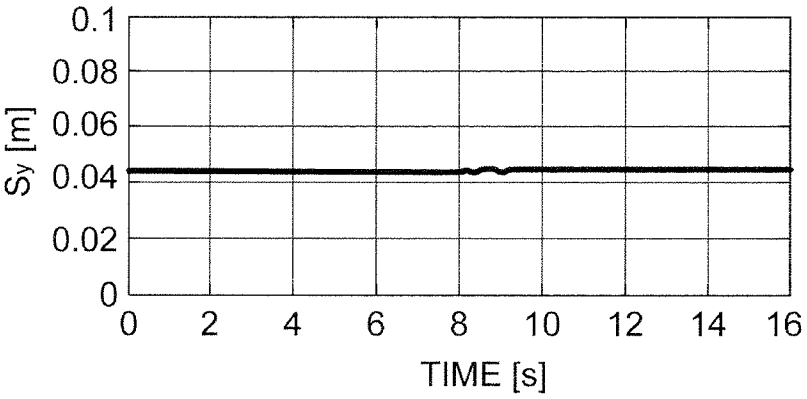
FIGS. 16A to 16D are graphs illustrating a temporal change in a distance $S_y$ between the discharge port and the center of the sprue in the Y direction, and a temporal change in a distance between the discharge port and the sprue in a Z direction at the time of pouring.
Figure 16B:
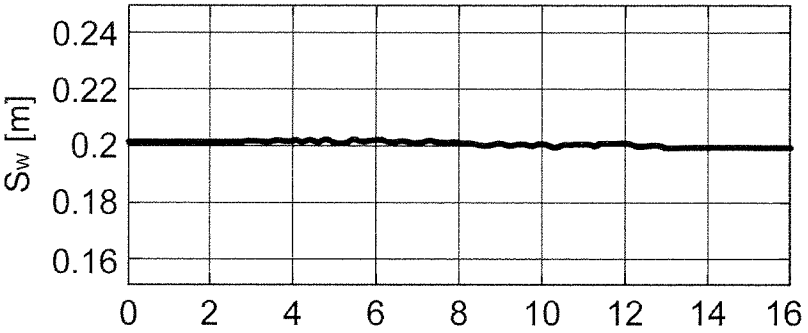
Figure 16C:
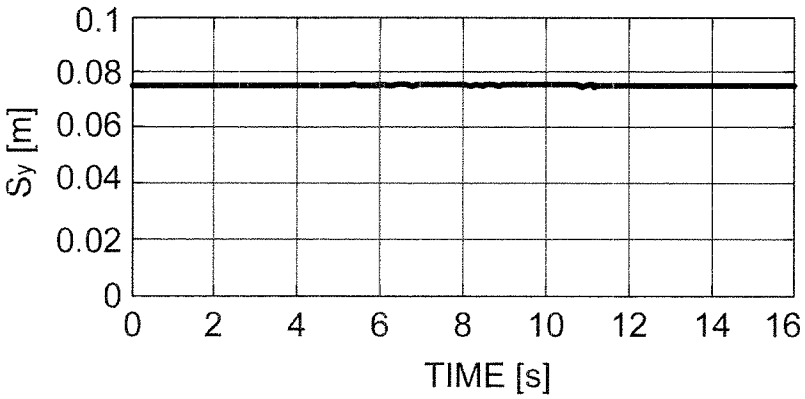
Figure 16D:
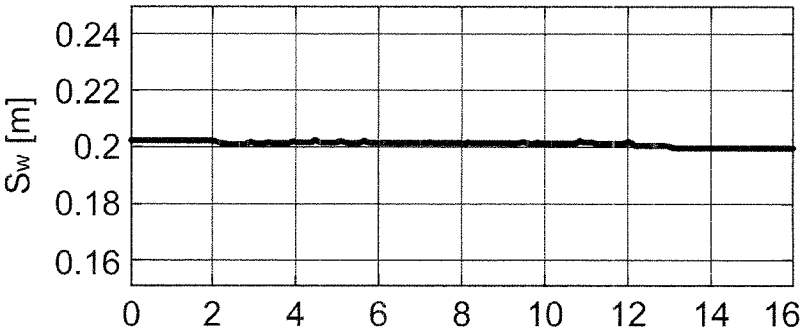

Next, refer to FIGS. 16A to 16D. FIG. 16A and FIG. 16B respectively illustrate a temporal change in the distance $S_y$ and a temporal change in the distance $S_w$ from the pouring start time point to the pouring completion time point in Experimental Example 1. FIG. 16C and FIG. 16D respectively illustrate a temporal change in the distance $S_y$ and a temporal change in the distance $S_w$ from the pouring start time point to the pouring completion time point in Experimental Example 2.

As illustrated in FIGS. 16A to 16D, in Experimental Example 1 and Experimental Example 2, it is confirmed that the ladle 2 is not moved in the Y direction and the Z direction during a period from the pouring start time point to the pouring completion time point. From such a result, in Experimental Example 1 and Experimental Example 2, it is confirmed that a fluid level vibration in the molten metal M, which occurs during pouring, can be reduced.

As described above, the automatic pouring apparatus and the control method for an automatic pouring apparatus according to the embodiment have been described, but the present invention is not limited to the embodiments described above, and various modification examples can be configured within a range not departing from the gist of the present invention. For example, the automatic pouring apparatus 1 may not necessarily include the third driving unit 5 and the retaining unit 6. In addition, a transport direction of the ladle 2 according to the first driving unit 3 is not limited to a direction orthogonal to the X direction which is a transport direction of the mold. Further, the shape or the application of the ladle 2 is not limited to the embodiment described above insofar as the discharge port 2*b* is disposed in the ladle 2.

What is claimed is:

1. A control method for an automatic pouring apparatus for pouring a molten metal into a mold transported along a first direction, the automatic pouring apparatus including, a ladle for storing the molten metal, the ladle including a discharge port for allowing the molten metal to flow out, a first driving unit for moving the ladle along a second direction orthogonal to the first direction, and a second driving unit for tilting the ladle, the method comprising:

obtaining a pouring flow rate of the molten metal flowing out from the discharge port;

calculating a dropping position of the molten metal on a horizontal surface passing through a height position of a sprue of the mold, a flow velocity of the molten metal in the dropping position, and a radius of a sectional surface of the molten metal on the horizontal surface, on the basis of a dropping trajectory of the molten metal flowing out from the discharge port;

determining a flow rate of the molten metal flowing into the mold on the basis of the dropping position, the flow velocity of the molten metal in the dropping position, the radius of the sectional surface of the molten metal on the horizontal surface, a radius of the sprue and the pouring flow rate;

determining a total weight of the molten metal flowing into the mold on the basis of the flow rate of the molten metal flowing into the mold and a density of the molten metal;

determining an optimal distance between the discharge port and the sprue in the second direction, the optimal distance being a distance in which the total weight of the molten metal flowing into the mold is maximized;

controlling the first driving unit such that a distance between the discharge port and the sprue in the second direction becomes the optimal distance; and controlling the second driving unit such that the ladle tilts at a position where the distance between the discharge port and the sprue in the second direction becomes the optimal distance.

2. The control method for the automatic pouring apparatus according to claim 1, wherein the total weight of the molten metal is determined based on a multiplication of the flow rate of the molten metal flowing into the mold with density of the molten metal.

3. The control method for the automatic pouring apparatus according to claim 2, the flow rate $Q_{in}(t)$ of the molten metal is determined by Expression (1-1) described below, and the total weight $W_{in}$ of the molten metal is determined by Expression (1-2) described below, wherein, in the Expressions (1-1) and (1-2), $S_v$ represents a distance between the discharge port and the dropping position in the second direction, $S_y$ represents the distance between the discharge port and a center of the sprue in the second direction, $v_l$ represents the flow velocity of the molten metal in the dropping position, $r_l$ represents the radius of the sectional surface of the molten metal on the horizontal surface, $r_s$ represents the radius of the sprue, q(t) represents the pouring flow rate, $A_{in}$ represents an area of a region in which the sprue overlaps with the sectional surface of the molten metal on the horizontal surface, ρ represents the density of the molten metal, and T represents pouring time,

[Expression 1]

$$Q_{in}(t) = \begin{cases} 0, & (|S_y - S_v(t)| - r_l(t) \geq r_s) \\ q(t), & (|S_y - S_v(t)| + r_l(t) \leq r_s) \\ A_{in}(t)v_l(t), & (\text{else}) \end{cases} \quad (1\text{-}1)$$

[Expression 2]

$$W_{in} = \rho \int_0^T Q_{in}(t)dt. \quad (1\text{-}2)$$

4. An automatic pouring apparatus for pouring a molten metal into a mold transported along a first direction, the apparatus comprising:

a ladle for storing the molten metal, the ladle including a discharge port for allowing the molten metal to flow out;

a first driving unit for moving the ladle along a second direction orthogonal to the first direction;

a second driving unit for tilting the ladle; and a control unit controlling the first driving unit and the second driving unit, wherein the control unit obtains a pouring flow rate of the molten metal flowing out from the discharge port, calculates a dropping position of the molten metal on a horizontal surface passing through a height position of a sprue of the mold, a flow velocity of the molten metal in the dropping position, and a radius of a sectional surface of the molten metal on the horizontal surface, on the basis of a dropping trajectory of the molten metal flowing out from the discharge port, determines a flow rate of the molten metal flowing into the mold on the basis of the dropping position, the flow velocity of the molten metal in the dropping position, the radius of the sectional surface of the molten metal on the horizontal surface, a radius of the sprue and the pouring flow rate, determines a total weight of the molten metal flowing into the mold on the basis of the flow rate of the molten metal flowing into the mold and a density of the molten metal, determines an optimal distance between the discharge port and the sprue in the second direction, the optimal distance being a distance in which the total weight of the molten metal flowing into the mold is maximized, controls the first driving unit such that a distance between the discharge port and the sprue in the second direction becomes the optimal distance, and controls the second driving unit such that the ladle tilts at a position where the distance between the discharge port and the sprue in the second direction becomes the optimal distance.

5. A non-transitory computer-readable recording medium storing a control program for allowing an automatic pouring apparatus to function to pour a molten metal into a mold transported along a first direction, the automatic pouring apparatus including, a ladle for storing the molten metal, the ladle including a discharge port for allowing the molten metal to flow out, a first driving unit for moving the ladle along a second direction orthogonal to the first direction, a second driving unit for tilting the ladle, and a control unit controlling the first driving unit and the second driving unit, the program allowing the control unit to execute:

obtaining a pouring flow rate of the molten metal flowing out from the discharge port;

calculating a dropping position of the molten metal on a horizontal surface passing through a height position of a sprue of the mold, a flow velocity of the molten metal in the dropping position, and a radius of a sectional surface of the molten metal on the horizontal surface;

determining a flow rate of the molten metal flowing into the mold on the basis of a dropping trajectory of the molten metal flowing out from the discharge port;

determining a flow rate of the molten metal flowing into the mold on the basis of the dropping position, the flow velocity of the molten metal in the dropping position, the radius of the sectional surface of the molten metal on the horizontal surface, a radius of the sprue and the pouring flow rate;

determining a total weight of the molten metal flowing into the mold on the basis of the flow rate of the molten metal flowing into the mold and a density of the molten metal;

determining an optimal distance between the discharge port and the sprue in the second direction, the optimal distance being a distance in which the total weight of the molten metal flowing into the mold is maximized;

controlling the first driving unit such that a distance between the discharge port and the sprue in the second direction becomes the optimal distance; and controlling the second driving unit such that the ladle tilts at a position where the distance between the discharge port and the sprue in the second direction becomes the optimal distance.

* * * * *